US006251210B1

(12) United States Patent
Bullock et al.

(10) Patent No.: US 6,251,210 B1
(45) **Date of Patent: *Jun. 26, 2001**

(54) TREATED TEXTILE FABRIC

(75) Inventors: Kyle Bullock, Forest City, NC (US); Craig A. Rubin; Randy B. Rubin, both of Franklin, MI (US)

(73) Assignee: Hi-Tex, Inc., Farmington Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/072,143

(22) Filed: May 4, 1998

Related U.S. Application Data

(63) Continuation-in-part of application No. 08/687,527, filed on Aug. 8, 1996, now Pat. No. 6,024,823, and a continuation-in-part of application No. 09/050,514, filed on Mar. 30, 1998.

(51) Int. Cl.[7] ..... B32B 31/00

(52) U.S. Cl. ..... 156/272.2; 156/307.1; 427/412.3; 427/532

(58) Field of Search ..... 525/452, 31, 926, 525/28, 455, 459; 524/591; 428/290, 288, 296, 394, 500, 516, 517; 427/482.1, 412.3, 516, 532; 156/278, 307.1, 272.2

(56) References Cited

U.S. PATENT DOCUMENTS

| | | | | |
|---|---|---|---|---|
| 3,023,072 | | 2/1962 | Dabrowski . | |
| 3,111,361 | | 11/1963 | Fang . | |
| 3,238,010 | | 3/1966 | Habib et al. . | |
| 3,419,533 | | 12/1968 | Dieterich . | |
| 3,479,310 | | 11/1969 | Dieterich . | |
| 3,521,993 | | 7/1970 | Swidler et al. . | |
| 3,652,198 | | 3/1972 | Farber et al. . | |
| 3,713,878 | | 1/1973 | Thomas . | |
| 3,922,399 | | 11/1975 | Ochsner . | |
| 4,027,062 | | 5/1977 | Engelbrecht et al. . | |
| 4,108,814 | | 8/1978 | Reiff et al. . | |
| 4,113,432 | | 9/1978 | Otto . | |
| 4,183,836 | | 1/1980 | Wolfe, Jr. . | |
| 4,189,429 | | 2/1980 | Lambert, Jr. . | |
| 4,203,883 | | 5/1980 | Hangauer, Jr. . | |
| 4,256,459 | | 3/1981 | Russell et al. . | |
| 4,365,968 | | 12/1982 | Gregorian et al. . | |
| 4,408,008 | | 10/1983 | Markusch . | |
| 4,496,363 | | 1/1985 | DeFilippi . | |
| 4,507,413 | * | 3/1985 | Thoma et al. | 524/42 |
| 4,507,430 | | 3/1985 | Shimada et al. . | |
| 4,518,649 | | 5/1985 | Wang et al. . | |
| 4,594,286 | * | 6/1986 | McKinney et al. | 428/245 |
| 4,598,120 | | 7/1986 | Thoma et al. . | |
| 4,721,511 | | 1/1988 | Kupits . | |
| 4,775,384 | | 10/1988 | Bachem et al. . | |
| 4,795,675 | | 1/1989 | Dunn, Jr. et al. . | |
| 4,833,006 | | 5/1989 | McKinney et al. . | |
| 4,835,019 | | 5/1989 | White et al. . | |
| 4,844,952 | | 7/1989 | Korenkiewicz et al. . | |
| 4,861,501 | | 8/1989 | Pfeifer . | |
| 4,889,765 | * | 12/1989 | Wallace | 428/290 |
| 4,901,389 | | 2/1990 | Poulenard et al. . | |
| 4,921,756 | | 5/1990 | Tolbert et al. . | |
| 4,996,099 | | 2/1991 | Cooke et al. . | |
| 5,009,667 | | 4/1991 | Beck et al. . | |
| 5,091,243 | | 2/1992 | Tolbert et al. . | |
| 5,126,138 | | 6/1992 | McGee et al. . | |
| 5,177,141 | * | 1/1993 | Thoma et al. | 524/591 |
| 5,194,667 | | 3/1993 | Oxenrider et al. . | |
| 5,196,080 | | 3/1993 | Mizobuchi et al. . | |
| 5,306,764 | * | 4/1994 | Chen | 524/591 |
| 5,565,265 | | 10/1996 | Rubin et al. . | |
| 5,747,392 | | 5/1998 | Xiao et al. . | |
| 6,024,823 | | 2/2000 | Rubin et al. . | |
| 6,165,920 | | 12/2000 | Rubin et al. . | |

FOREIGN PATENT DOCUMENTS

| | | |
|---|---|---|
| 32 31 062 A1 | 2/1984 | (DE) . |
| 34 15 920 A1 | 11/1985 | (DE) . |
| 38 36 030 A1 | 5/1990 | (DE) . |
| 0 097 995 A2 | 1/1984 | (EP) . |
| 0 525 671 A1 | 2/1993 | (EP) . |
| 1-97274 | 4/1989 | (JP) . |
| 3-195737 | 8/1991 | (JP) . |
| 6-31845 | 2/1994 | (JP) . |
| 6-108365 | 4/1994 | (JP) . |

OTHER PUBLICATIONS

John C. Tsirovasiles et al, *The Use of Water–Borne Urethane Polymers in Fabric Coatings*, J. Coated Fabrics (1986), Oct. 16, pp. 114–122.

Joseph W. Weinberg, *Performance And Application Advantages of Waterborne systems In The Automotive And Textile Industries*, J. Industrial Fabrics (1986) 4(4), pp. 29–38.

* cited by examiner

*Primary Examiner*—Merrick Dixon
(74) *Attorney, Agent, or Firm*—Brooks & Kushman P.C.

(57) ABSTRACT

A method of preparing a stain resistant and water repellant textile fabric comprising:

a) treating a textile fabric with an aqueous primary treatment composition comprising at least about 5 weight percent of a fluorochemical textile treating agent, based on the weight of the primary treatment composition;

b) drying the treated fabric at an elevated temperature to obtain a primarily treated fabric;

c) providing a polymeric film on one side of the primarily treated fabric, the film comprising an aqueous secondary treatment composition comprising at least about 4 weight percent of a fluorochemical textile treating agent, based on the weight of the secondary treatment composition; and d) drying the treated fabric with the film at an elevated temperature to obtain a secondarily treated fabric.

29 Claims, No Drawings

TREATED TEXTILE FABRIC

TECHNICAL FIELD

This application is a continuation-in-part of U.S. patent appilcation Ser. No. 08/687,527, filed Aug. 8, 1996, U.S. Pat. No. 6,024,823, entitled "Treated Textile Fabric", and U.S. patent application Ser. No. 09/050,514, filed Mar. 30, 1998, pending, entitled "Treated Textile Fabric" which are hereby incorporated by reference.

The present invention relates to treated textile fabrics, and more particularly to methods of treating a fabric to produce a water-repellant, stain-resistant, anti-microbial, fabric which display excellent hand and feel, and which may be used in traditional textile applications such as furniture upholstery. The present invention further pertains to textile treating compositions useful for preparing such fabrics.

BACKGROUND OF THE INVENTION

Stain resistance, water repellency and resistance to microbial growth are important in many uses of textile materials. In restaurants, for example, table cloths and seating upholstery often lack stain resistance and are subject to rapid water penetration. These properties necessitate frequent cleaning and/or replacement of such items. Although one generally views microbial growth as associated with fibers of biologic origin such as cotton, wool, linen, and silk, in the field of marine use, the high relative humidity renders even synthetic polymer textiles such as polyesters and polyamides subject to microbial growth, which is also true of many other outdoor uses.

Water repellant textile fabrics may be made by various processes. The term "water repellant" as used herein means essentially impermeable to water, i.e. treated textile can support a considerable column of water without water penetration through the fabric. Such behavior is sometimes termed "water resistant." However, the last term generally implies a lesser degree of water repellency and further can be confused with the chemical use of "water resistant" to refer to coatings which are chemically stable to water or which will not be washed off by water. Hydrophobicizing topical treatments are incapable of providing the necessary degree of water repellency as that term is used herein.

Waxes and wax-like organic compounds have often been used to provide limited degrees of water repellency. For example, textile fabrics may first be scoured with a soap solution and then treated with a composition which may include zinc and calcium stearates as well as sodium soaps. The long chain carboxylic acid hydrophobic compounds provide a limited amount of water repellency. It is also possible to render fabrics liquid resistant by treating the fabric with commercially available silicones, for example poly(dimethylsiloxane). In tenting fabrics, use is commonly made of paraffin waxes, chlorinated paraffin waxes, and ethylene/vinyl acetate copolymer waxes. Typical of such formulations are those disclosed in U.S. Pat. No. 4,027,062, a wax-based organic solvent-borne system; and U.S. Pat. No. 4,833,006, which employs a wax-based, organic solvent-borne system further containing an unblocked polyisocyanate as an adhesion promoter. The use of the unblocked isocyanate is said to decrease the peeling or flaking off of the coating as compared to wax-based systems employing blocked isocyanate-terminated prepolymers as disclosed in U.S. Pat. No. 4,594,286. Such treated fabrics have a coarse, waxy hand and feel, exhibit little water vapor permeability, are not resistant to organic solvents, and are limited in the manner in which they can be printed.

To overcome problems associated with water absorption and stain resistance, particularly in upholstery materials, resort has been made to synthetic leathers and polyvinylchloride (vinyl) coated fabrics. However, these fabrics do not have the hand or feel of cloth, and in general, are difficult and in many cases impossible to print economically. Moreover, although attempts have been made to render such materials water vapor permeable, these attempts have met with only very limited success, as evidenced by the failure of synthetic leather to displace real leather in high quality seating and footwear. For example, U.S. Pat. No. 4,507,413 discloses leather-like coatings prepared from an aqueous dispersion of a blocked, isocyanate-terminated polyurethane containing a water soluble thickener. The top coating is coated onto a release paper, cured with diamine, and then bonded with the aid of a bonding coat to a fabric support. Following removal of the release paper, a grained, leather-like coating is obtained. In U.S. Pat. No. 5,177,141, similar coatings are disclosed which, in addition, require a water immiscible solvent to be dispersed with the polyurethane, and further requires the presence of a hydrophilic polyisocyanate to promote adhesion to the textile substrate. The presence of the water-immiscible solvent produces a pore-containing material by evaporative coagulation, leading to high water vapor permeability.

Although the treating and coating methods discussed previously may assist in rendering the fabric partially liquid and/or stain resistant, the leather-like appearance of fabrics coated as disclosed by U.S. Pat. Nos. 4,507,413 and 5,177,141 is not desired in many fabric applications. Despite their higher water vapor permeability as compared to earlier generation synthetic leathers, such products are still uncomfortable in many seating upholstery applications. Furthermore, fabrics treated or coated with wax-like polymer or wax emulsions cannot be satisfactorily printed. The treated liquid resistant fabrics may refuse to accept or become incompatible with the application of color dyes. The polymeric coated liquid resistant fabrics cannot be transfer printed because the heat required in the printing process generally causes the polymeric coating to melt or deform. Thus, if a fabric with a particular design or logo is required, the textile fabric must be printed first by traditional methods, following which it may be treated or polymer coated. However, the polymer coating generally obscures the design due to its thickness and opacity, even when non-pigmented vinyl, for example, is used.

Applications of relatively small amounts of fluorochemicals such as the well known SCOTCHGUARD™ and similar compounds also may confer a limited degree of both water resistance and stain resistance, as discussed previously. However, for optimal water repellency, it has proven necessary to coat fabrics with thick polymeric coatings which completely destroy the hand and feel of the fabric. Examples include vinyl boat covers, where the fabric backing is rendered water resistant by application of considerable quantities of polyvinylchloride latex or the thermoforming of a polyvinyl film onto the fabric. The fabric no longer has the hand and feel of fabric, but is plastic-like. Application of polyurethane films in the melt has also been practiced, with similar results. However, unless aliphatic isocyanate-based polyurethanes are utilized, the coated fabric will rapidly weather.

Coatings of polyurethanes or polyurethane ureas have been disclosed in numerous patents and publications. However, the majority of these coatings, such as those previously described, produce fabrics whose hand and feel is not acceptable, i.e. are synthetic leather-like in appearance. Moreover, in producing non-leather-like fabrics coated with polyurethane, it is generally necessary to dissolve the polyurethane into a solvent, and apply this solution to the fabric. Polyurethane lattices, in general, have not been used to provide a fabric with a soft feel, because the prepolymer viscosity of polyurethanes necessary to provide soft coatings is so high that dispersions cannot be prepared. Thus, solvent-borne polyurethanes have been used. Unfortunately, it is increasingly difficult to utilize solvent-borne coatings of any kind in both industrial and domestic applications due to pollution laws. Examples of the foregoing coatings are disclosed in Japanese patent JP 06108365 A2, "Moisture Permeable Water-Resistant Polyurethane-Coated Fabrics And Their Manufacture"; U.S. Pat. No. 5,306,764, "Water Dispersable Polyurethane-Urea Coatings And Their Preparation"; Japanese patent JP 06031845, "Manufacture of Water-Resistant Moisture-Permeable Laminated Fabrics"; European published application EP 525671 A1, "Water-Borne Resin Compositions and Automobile Interior Fabrics Coated With Same"; Japanese patent 03-195737 A2, "Aqueous Polyurethane Acrylate Dispersions"; German patent DE 3 836 030 A1, "Aqueous Polyurethane Dispersions For Moisture-Permeable Coatings"; U.S. Pat. No. 4,889,765, "Ink-Receptive, Water-Based Coatings"; Japanese patent JP 01097274 A2, "Moisture-Permeable Waterproof Sheets"; John C. Tsirovasiles et al., "The Use of Water-Borne Urethane Polymers in Fabric Coatings", J. Coated Fabrics Oct. 16, 1985, pp. 114–22; Weinberg, Joseph W., "Performance and Application Advantages of Water-Borne Systems In Automotive And Textile Industries", J. Industrial Fabrics (1986) 4(4), pp. 29–38; German patent DE 34 15 920 A1, "Aqueous Dispersions For Coating of Textiles"; and German patent DE 323 10 62 A1, "Aqueous Dispersions of Reactive Polyurethanes for Coatings".

The foregoing references all produce fabrics with severe deficiencies in numerous areas. The most severe deficiency in many of these fabrics is the inability to be transfer-printed. Transfer printing requires elevated temperatures at which the bulk of these coatings melt and adhere to the transfer printing drum. The inability to be transfer-printed requires that the fabrics be printed by conventional textile printing methods. However, the use of such methods is impractical in short runs of less than, for example, 10,000 meters of material. Thus, it is impossible to economically produce unique designs in short runs of fabric.

It would be desirable to provide a fabric that allows water vapor to pass through the fabric while prohibiting the passage of liquid. It would also be desirable to provide a method of producing a liquid repellant, strain resistant, antimicrobial fabric. It would further be desirable to provide a liquid repellant, stain resistant, antimicrobial fabric that retains its natural hand and texture, is easy to handle, and economical to produce. It would be yet further desirable to provide a method of producing a liquid repellant, stain resistant, antimicrobial fabric that may be transfer printed.

SUMMARY OF THE INVENTION

The present invention provides a method of preparing a water-repellant, stain-resistant, antimicrobial fabric that retains the hand and feel of fabric rather than being leather-like or plastic-like. The fabrics of the present invention are prepared by treating a fabric with an aqueous, primary treatment composition comprising at least about 5 weight percent of a fluorochemical textile treating agent followed by at least one treatment of a polymeric secondary treatment composition comprising at least about 4 weight percent of a fluorochemical textile treating agent.

BEST MODES FOR CARRYING OUT THE INVENTION

The water repellant, stain resistant, antimicrobial, fabric prepared by the method of the present invention retains its natural "hand" or texture and is therefore aesthetically and texturally appealing. The fabric of the present invention is also durable, easy to handle and economical to produce.

The fabrics useful in the present invention include many textile materials which include, but are not limited to, woven, non-woven and knitted fabrics, and preferably yarn or piece dyed upholstery woven fabrics, of natural fibers, synthetic fibers and mixtures of natural and synthetic fibers. Suitable natural fibers include, but are not limited to, fibers of cotton, linen, ramie, silk, wool and the like. Suitable synthetic fibers include, but are not limited to, fibers of polyamides (nylon), polyester, polyacrylic, rayon, acetate and the like. Suitable fabrics for use with the present invention include, but are not limited to, jacquards (i.e., fabrics manufactured from a jacquard loom), brocades, dobbys (i.e., fabrics manufactured from a dobby loom), base fabrics comprising corespun yarn containing fiberglass overwrapped with a synthetic polymeric fiber, and canvases. When the base fabric comprises a corespun yarn containing fiberglass overwrapped with a synthetic polymeric fiber, the treated fabric is suitable for replacing the flame barrier and printed fabric in upholstery and other applications, and is further suitable for highly flame retardant commercial and industrial uses, for example, as drapery material. Examples of such corespun yarns may be found in U.S. Pat. Nos. 4,921,756; 4,996,099 and 5,091,243, herein incorporated by reference.

The method of preparing stain resistant and water repellant textile fabric of the subject invention involves, treating textile fabrics with a treatment system comprising, in a first step, treating an untreated fabric with a penetrating topical composition, hereinafter referred to as the primary treatment composition. The primary treatment composition preferably has a viscosity of less than about 1000 cps (centipoise) at room temperature and minimally comprises, in its most basic nature, a fluorochemical treating agent in a substantial amount. The primary treatment composition may also contain one or more antimicrobial agents, such as microbicides and/or mildewcides, and water. The primary treatment composition may further also contain a relatively small amount of one or more polymeric latexes. The primary treatment composition preferably comprises from about 1 to about 40 weight percent solids, based on the weight of the primary treatment composition, and more preferably from about 5 to about 25 weight percent solids, and most preferably from about 10 to about 20 weight percent solids.

The fabric to be treated may be drawn through a treating bath of the primary treatment composition by any convenient method, or the primary treatment composition may be sprayed or rolled onto the fabric. Preferably, the fabric, previously scoured to remove textile yarn finishes, soaps, etc., is drawn through the bath, as the primary treatment composition should uniformly coat both sides (i.e., surfaces) of the fabric as well as penetrating the surfaces of the fabric to cover the interstitial spaces within the fabric. The fabric, after being drawn through the bath, may be passed through nips or nip rollers to facilitate a more thorough penetration of the treating composition into the fabric and/or to adjust the amount of treatment composition picked up by the fabric. By such or other equivalent means, the pickup is preferably adjusted to provided from 30 to 200 weight percent pickup relative to the weight of the untreated fabric, more preferably from 60 to 150 weight percent, and most preferably from 80 to 120 weight percent. A 100 weight percent addition of treatment solution is considered optimal with normal primary bath solids content. The treated fabric is then dried. While the fabric may be dried in any manner, it is preferred that it be passed through an oven maintained at an elevated temperature, preferably from 250° F. to 350° F. (121° C. to 277° C.) for a period sufficient to dry the applied coating, and, if the first treatment step is not to be followed by additional treatment, to perform any necessary crosslinking of the components of the treatment composition. Generally, a period of from 1 to 8 minutes, preferably about 2 minutes at 325° F. (163° C.) is sufficient. The drying step produces a primarily treated fabric. The primarily treated fabric is mildew resistant, stain resistant and water repellant. In addition, its tensile and tear strengths are markedly improved. Yet, the primarily treated fabric is very difficult to distinguish from untreated fabric by hand, feel, texture, or ease of handling.

Although the process described above creates a unique new textile material, the new textile material may not be completely water repellant. Inspection of the primarily treated fabric against a light source may reveal multitudinous "pinholes" which may ultimately allow water to pass through the fabric. To render the primarily treated fabric more completely water repellant, one or more additional coating steps, or secondary treatments, are applied, depending on the degree of water repellency desired. The secondary treatments, if more than one is applied, are the same, and involve the application of a secondary treatment composition which minimally comprises, in its most basic nature, a polymeric latex and a fluorochemical treating agent. The secondary treatment composition may also contain one or more antimicrobial agents, such as microbicidides and/or mildewcides. The secondary treatment composition preferably has a viscosity, at room temperature, of from about 25,000 cps to about 60,000 cps, and more preferably from about 30,000 cps to about 50,000 cps, and most preferably from about 35,000 cps to about 45,000 cps. Moreover, the secondary treatment composition preferably comprises from about 30 to about 70 weight percent solids, based on the weight of the secondary treatment composition, and more preferably from about 40 to about 60 weight percent solids, and most preferably from about 40 to about 50 weight percent solids.

The secondary treatment composition is applied to one side of the primarily treated fabric. The secondary treatment composition, which preferably has a consistency that is similar to that of wallpaper paste or high solids wood glue, is rolled, sprayed, or otherwise applied to the primarily treated fabric which then passes under a knife blade, doctor blade, or roller that essentially contacts the primarily treated fabric surface, leaving a thin coating of about 1–5 oz/yd$^2$, and preferably about 1.5 oz/yd$^2$, of material. The coated primarily treated fabric is then dried in any suitable manner, and preferably oven dried at 250° F. to 350° F. (121° C. to 277° C.) resulting in a secondarily treated fabric.

The resulting secondarily treated fabric still retains excellent hand and feel, although being less drapeable than the untreated virgin fabric. If inspection against a light shows very few pinholes, application of a somewhat thicker coating may further reduce the quantity of pinholes. However, even with a relatively few pinholes, the secondarily treated fabric is virtually completely water repellant, and is able to support a considerable column of water without leakage. If further water repellency is required, this secondary treatment may be repeated.

The present invention may be further understood in relation to the following detailed description of specific embodiments of treatment systems and the fabrics so treated by the treatment systems are described in more detail. It should be understood that the term "weight percent", as used with respect to the components of the compositions of the present invention, refers to the total weight of the components of the compositions of the present invention and not to the weight percents of the solids or polymers in the components of the compositions of the present invention, unless otherwise specified.

First Embodiment

In a first treatment system comprising a first embodiment of the present invention, the primary treatment composition comprises minimally a urethane latex, an acrylic latex, a crosslinking resin, one or more antimicrobial agents and an organic fluorochemical textile treating agent. The first treatment system is useful with any of the above-mentioned fabrics and is particularly well suited for synthetic woven fabrics. The primary treatment composition is preferably applied to the fabric as a dispersion and is dried and cured at an elevated temperature, preferably at a temperature of 250–350° F. (121° C.–181° C.) for 1 to 5 minutes, resulting in a primarily treated fabric of the first embodiment.

The resulting primarily treated fabric is water-repellant, stain-resistant, weather-resistant, can be transfer-printed, and yet looks and feels like traditional high quality textile materials. While not wishing to be bound to any particular theory, it is believed that the physical properties of the subject fabrics are due to the use of the inventive coatings which are the result of a combination of dispersed phase particle coalescence and cross-linked structure which produces an interpenetrating polymer network (IPN) which also permeates the inter-yarn spacings and may at least partially coat the individual fibers themselves.

The urethane latex must be compatible with the acrylic latex to prepare the coatings. It should be noted that no urethane acrylate is required, although its presence is not excluded. Rather, the urethane latex and acrylic latex are discrete polymers prior to cure. By "acrylic latex compatible" is meant a urethane latex which, when mixed with the acrylic latex, produces a dispersion which is storage stable in the sense that resin viscosity does not increase substantially to the point where it is unusable after several days of storage at 25–35° C., and which does not gel, coagulate, or flocculate when mixed. A simple test for compatibility is to mix together the desired components at 25° C. and observe the dispersion for gelation, coagulation, or flocculation. If none has occurred within a few minutes, then the dispersion is bottled and stored in a warm oven at 35° C. For several days. If no severe increase in viscosity has occurred during this time, and no significant amount of gelation, coagulation, or flocculation, then the urethane latex is an acrylic-compatible urethane latex. Anionic polyurethane lattices are preferred.

Anionic polyurethane lattices are commercially available. Such lattices prepared by reacting an isocyanate component with a polyol component containing dimethylolpropionic acid (DMPA) in such a way that anionic stabilizing groups are incorporated into the resultant prepolymer. The isocyanate-terminated prepolymer is then neutralized with an organic base dispersed into water and chain extended with an amino-functional chain extender, preferably a diamine. The anionic stabilizing groups are necessary in order to prepare a uniform and stable dispersion. It is of paramount importance that the dispersed phase be capable of coalescing either upon coating of a substrate or at an elevated temperature cure.

Methods of preparation of polyurethane lattices are now well known, as illustrated by U.S. Pat. Nos. 3,479,310; 4,183,836; 4,408,008; and 4,203,883, and U.S. patent application Ser. No. 08/752,429, field Nov. 19, 1996, entitled "Interpenetrating Polymer Network Fabric Coating and Stain and Water Resistant Fabric Coated Therewith," all of which are herein incorporated by reference. The preparation generally involves the reaction of a polyether diol in admixture with a dispersing aid with a stoichiometric excess of isocyanate, followed by neutralization with base, dispersion in water, chain extension with diamines, and conversion of the dispersing group to anionic form.

Modest to high molecular weight polyether diols generally comprise a major portion, i.e. greater than 50 weight percent, preferably greater than 80 weight percent, of the polyol component used to prepare the isocyanate-terminated prepolymer. The polyether diols are preferably poly (oxypropylene) glycols, and preferably have molecular weights between about 1000 Da and 8000 Da. By the term "polyol component" is meant that portion of the isocyanate-reactive ingredients which is exclusively hydroxyl-functional and is used to form the prepolymer, other than reactive dispersing aids. Thus, the polyol component may include minor amounts of hard-segment from short chain diols, for example, but not limited to: ethylene glycol, 1,3-propylene glycol, 1,4-butanediol, 1,6-hexanediol, 1,4-cyclohexanediol, 1,4-cyclohexanedimethanol, 4,4'-dihydroxybihenyl, neopentyl glycol, 2,2,4-trimethylpentanediol, and polyoxyalkylene oligomers with molecular weights of less than about 300. Mixtures of these low molecular weight species may also be used. The polyol component may further include a minor amount of other high molecular weight diols such as polyester diols, polytetramethylene ether glycols (PTMEG), and the like. Molecular weights herein are number average molecular weights in Daltons (Da) unless otherwise specified.

The isocyanates useful in the preparation of the subject polyurethane dispersions may, in general, be any organic di- or polyisocyanate, whether aliphatic or aromatic. However, preferred isocyanates are the commercially available isocyanates toluene diisocyanate (TDI), methylenediphenylene diisocyanate (MDI), and their saturated analogs. Toluene diisocyanate is generally used as an 80:20 mixture of 2,4- and 2,6-TDI, although other mixtures such as the commercially available 65:35 mixture as well as the pure isomers are useful as well. Methylenediphenylene diisocyanate may also be used as a mixture of 2,4'-, 2,2'-, and 4,4'-MDI isomers. A wide variety of isomeric mixtures are commercially available. However, most preferable is 4,4'-MDI or this isomer containing minor amounts of the 2,4'- and 2,2'-isomers.

Preferred aliphatic isocyanates are the alkylene diisocyanates such as 1,6-diisocyanatohexane, 1,8-diisocyanatooctane, and linear diisocyanates having interspersed heteroatoms in the alkylene residue, such as bis(3-isocyanatopropyl)ether. More preferred aliphatic isocyanates are the various cycloaliphatic a isocyanates such as those derived from hydrogenated aryldiamines such as toluene diamine and methylene-dianiline. Examples are 1-methyl-2,4-diisocyanatocyclohexane and 1-methyl-2,6-diisocyanatocyclohexane; bis(4-isocyanatocyclohexyl) methane and the isomers thereof; 1,2-, 1,3-, and 1,4-bis(2-(2-isocyanatopropyl))benzene; and isophorone diisocyanate.

Modified isocyanates based on TDI and MDI are also useful, and many are commercially available. For example, small quantities, generally less than one mole of an aliphatic glycol or modest molecular weight polyoxyalkylene glycol or triol may be reacted with 2 moles of diisocyanate to form a urethane modified isocyanate. Also suitable are the well known carbodiimide, allophanate, uretonimine, biuret, and urea modified isocyanates based on MDI or TDI. Mixtures of diisocyanates and modified diisocyanates may be used as well.

The isocyanate should be present in an amount sufficient to ensure isocyanate-termination of the prepolymer. The ratio of isocyanate groups to isocyanate-reactive groups contained in the polyol component, dispersing aid component, and any other reactive components present during prepolymer formation should, in general, range from 1.1 to 4, preferably 1.5 to 2.5, and more preferably 1.5 to 2.2 on an equivalent basis. The resulting prepolymers should desirably have isocyanate group (NCO) contents of between 1 and 8 weight percent, and more preferably 1 to 5 weight percent, based on the weight of the prepolymer. Prepolymer formation may be conducted neat or in non-reactive solvent, generally an aprotic water soluble or water miscible solvent such as dimethylformamide, N-methylpyrrolidone, tetrahydrofuran, methylethylketone, acetone, and the like. For low VOC lattices, the solvent should be removed prior to or after dispersion in water. Reaction temperatures below 150° C., preferably between 50 and 130° C. are suitable. The reaction may be catalyzed by known catalysts, for example tin(II) octoate, dibutyltin dilaurate, dibutyltin diacetate, and the like, in amounts of 0.001 to about 0.1 weight percent, preferably 0.005 to 0.05 weight percent based on the weight of the prepolymer. Other catalysts are suitable as well.

For a stable dispersion, the prepolymer should contain one or more dispersing aids. The dispersing aid component may comprise a single dispersing aid or a mixture of one or more compatible dispersing aids, at least one of which must be reactive with the isocyanate component or the polyol component, preferably the former, and is considered when calculating the equivalent ratio of NCO-groups to NCO-reactive groups. In general, for example, the use of both cationic and anionic group-containing dispersing aids is not recommended, as these groups may inter-react, resulting in flocculation, coagulation, or precipitation of the prepolymer from the dispersion. Anionic and hydrophilic diols or diamines are preferred. Examples of suitable anionic diols, preferably containing carboxylate or sulfonic acid groups, as well as cationic quaternary nitrogen groups or sulfonium groups, are disclosed in U.S. Pat. Nos. 3,479,310; 4,108,814; and 3,419,533. Preferred, however, are hydroxycarboxylic acids having the formula $(HO)_xR(COOH)_y$ where R represents an organic residue and x and y both represent values of 1–3. Examples include citric and tartaric acid. However, the preferred acid-containing diols are α,α-dimethylolalkanoic acids such as α,α-dimethylolacetic acid, and in particular, α,α-dimethylolpropionic acid. Polymers containing ionic groups or latent ionic groups and having isocyanate-reactive groups are also suitable. Examples include vinyl copolymers containing residues of acrylic acid and hydroxyethylacrylate or other hydroxyl-functional vinyl monomers.

Hydrophilic dispersing aids, as defined herein, are those non-ionic groups which impart hydrophilic character. Such groups may include oligomeric polyoxymethylene groups or preferably, polyoxyethylene groups. Particularly preferred are mono functional polyoxyethylene monols or copolymer monols based on ethylene oxide and propylene oxide where a major portion of the oxyalkylene moieties are oxyethylene such that the monol as a whole is hydrophilic. Other hydrophilic, non-ionic polymers containing isocyanate reactive groups are useful as well. When hydrophilic, monofunctional dispersing aids are utilized, the isocyanate component may advantageously contain higher functional isocyanates such as the polymethylene polyphenylene polyisocyanates with functionalities between 2 and 2.4. Alternatively, the amount of diisocyanate may be increased and minor quantities of low molecular weight, isocyanate reactive, polyfunctional species such as glycerine, trimethylol-propane, diethanolamine, triethanolamine and the like, generally considered in polyurethane chemistry as cross-linking agents, may be added to counteract the chain blocking effect of monofunctional monols. However, addition of polyfunctional species is known to sacrifice some properties.

The dispersing aid component, containing one or more dispersing aids, may be added to the prepolymer-forming ingredients during prepolymer formation, thus being randomly incorporated into the prepolymer molecular structure, or may be added following the reaction of the di- or polyisocyanate with the polyol component. Cross-linking agents, as described previously, may also be added simultaneously or subsequently. Alternatively, when two or more dispersing aids are present in the dispersing aid component, one dispersing aid or a portion of the mixture of two or more dispersing aids may be added during prepolymer formation with the remainder added following prepolymer formation. Regardless of when the dispersing aids are added, the resulting dispersing aid-containing prepolymer should retain isocyanate-reactive functionality.

The prepolymer thus formed may be dispersed in water by any known method, for example by adding water with stirring until phase inversion occurs, but preferably by adding the prepolymer, either neat or dissolved in solvent, to water with vigorous stirring.

Either before or after the prepolymer has been dispersed, latent cationic or anionic groups, preferably anionic dispersing groups, are advantageously converted to the corresponding anion or cation, for example, conversion of carboxylic acid groups to carboxylate groups. Conversion of carboxylic acid groups to carboxylate groups may be accomplished by addition of a neutralizing agent, for example a tertiary amine such as triethylamine.

Following preparation of the prepolymer dispersion and conversion of all or a portion of latent ionic groups to ionic groups, the chain extender is added to the dispersion. The chain extender may be one of the known glycol chain extenders, but is preferably an amine-functional or hydroxylamine-functional chain extender. The chain extender may be added to the water before, during or after dispersing the prepolymer. If the chain extender is added after dispersing the prepolymer, then it should be added before the prepolymer has an opportunity to significantly react with water, normally within 30 minutes, preferably 15 minutes.

The amine chain extender is preferably a polyfunctional amine or a mixture of polyfunctional amines. The average functionality of the amine, i.e., the number of amine nitrogens per molecule, may be between about 1.8 and 6.0, preferably between about 2.0 and 4, and most preferably between about 2.0 and 3. The desired functionalities can be obtained by using mixtures of polyamines. For example, a functionality of 2.5 can be achieved by using equimolar mixtures of diamines and triamines. A functionality of 3.0 can be achieved either by using:

(1) triamines, (2) equimolar mixtures of diamines and tetramines, (3) mixtures of 1 and 2, or (4) any other suitable mixtures.

These other suitable mixtures for obtaining the desired functionalities will be readily apparent to those of ordinary skill in the art.

Suitable amines are essentially hydrocarbon polyamines containing 2 to 6 amine groups which have isocyanate-reactive hydrogens according to the Zerewitinoff test, e.g., primary or secondary amine groups. The polyamines are generally aromatic, aliphatic or alicyclic amines and contain between about 1 to 30 carbon atoms, preferably about 2 to 15 carbon atoms, and most preferably about 2 to 10 carbon atoms. These polyamines may contain additional substituents provided that they are not as reactive with isocyanate groups as the primary or secondary amines. Examples of polyamines for use in the present invention include the amines listed as low molecular compounds containing at least two isocyanate-reactive amino hydrogens, and also diethylene triamine, triethylene tetramine, tetraethylene pentamine, pentaethylene hexamine, N,N,N-tris-(2-aminoethyl)amine, N-(2-piperazinoethyl)ethylene diamine, N,N'-bis-(2-aminoethyl)piperazine, N,N,N'-tris-(2-aminoethyl)ethylene diamine, N-[N-(2-aminoethyl)-2-aminoethyl]-N'-(2-piperazinoethyl)-ethylene diamine, N-(2-amino-ethylene-N'-(2-piperazinoethyl)amine, N,N-bis-(2-piper-azinoethyl)-amine, polyethylene imines, iminobispropyl-amine, guanidine, melamine, N-(2-aminoethyl)-1,3-propane diamine, 3,3'diaminobenzidine, 2,4,6-triaminopyrimidine, polyoxypropylene amines, tetrapropylenepentamine, tripropylenetetramine, N,N-bis-(6-aminohexyl)amine, N,N'-bis-(3-aminopropyl)-ethylene diamine and 2,4-bis-(4'-aminobenzyl)-aniline. Preferred polyamines are 1-amino-3-aminomethyl-3,5,5-trimethyl-cyclohexane (isophorone diamine or IPDA), bis-(4-aminocyclohexyl)methane, bis-(4-amino-3-methylcyclohexyl)methane, 1,6-diamino-hexane, ethylene diamine, diethylene triamine, triethylene tetramine, tetraethylene pentamine and pentaethylene hexamine.

The amount of polyfunctional amine to be used in accordance with the present invention is dependent upon the number of terminal isocyanate groups in the prepolymer. Generally, the ratio of terminal isocyanate groups of the prepolymer to the amino hydrogens of the polyfunctional amine is between about 1.0:0.6 and 1.0:1.1, preferably between about 1.0:0.8 and 1.0:0.98 on an equivalent basis. Lesser amounts of polyfunctional amine will allow for undesired reaction of the isocyanate groups with water, while an undue excess may lead to products with low molecular weight and less than the desired amount of cross-linking, when cross-linking is desired. For the purposes of these ratios, a primary amine group is considered to have one amino hydrogen. For example, ethylene diamine has two equivalents of amino hydrogens and diethylene triamine has three equivalents.

The reaction between the dispersed prepolymer and the polyamine is conducted at temperatures from about 5° to 90° C., preferably from about 20° to 80° C., and most preferably from about 30° to 40° C. The reaction conditions are normally maintained until the isocyanate groups are essentially completely reacted. In order to reduce the presence of localized concentration gradients, the polyamine is preferably added slowly or in increments to the dispersed prepolymer which is normally agitated to ensure complete mixing of the polyamine throughout the aqueous medium. The polyamine may be added to the aqueous medium neat or it may be dissolved or dispersed in water or an organic solvent. Suitable organic solvents are those previously described for use in preparing the isocyanate-terminated prepolymer.

The final product is a stable, aqueous dispersion of colloidally-sized particles of urea-urethanes. The particle size is generally below about 1.0 micron, and preferably between about 0.001 to 0.5 micron. The average particle size should be less than about 0.5 micron, and preferably between 0.01 to 0.3 micron. The small particle size enhances the stability of the dispersed particles and also leads to the production of highly coalesced films.

It is to be understood that the methods of preparing the polyurethane dispersions of the present invention are exemplary, and other methods known to those skilled in the art may be used as well without departing from the spirit of the invention. Suitable methods, for example, are disclosed in U.S. Pat. Nos. 4,408,008; 4,507,430; 3,479,310; 4,183,836; and 3,238,010, which are herein incorporated by reference.

The acrylic latex comprises a dispersion of polymers and/or copolymers of acrylic or acrylate functional monomers, optionally copolymerized with other ethylenically unsaturated monomers. The nature of the monomers from which the polymer particles of the copolymer latex may be formed may be adjusted by one skilled in the art to provide the properties desired of the coated fabric. Preferably, the latex particles are acrylate copolymers, i.e. copolymers formed from lower alkyl acrylates such as methylacrylate, ethylacrylate, butylacrylate, methylmethacrylate, and the like, as well as additional copolymerizable monomers such as vinyl acetate, acrylonitrile, styrene, acrylic acid, acrylamide, N-methylacrylamide, and urethane acrylates. The presence of crosslinkable groups such as acrylamide and N-methylacrylamide along the polymer backbone is preferred. Terpolymers of styrene, methylacrylate, and ethylacrylate are very suitable. Some preferred copolymers include WRL1084, a styrene, methylacrylate, ethylacrylate copolymer containing N-methylacrylamide in the polymer backbone available from B.F. Goodrich, and Hycar® 1402 from the same source. The copolymer lattices are available in varying solids contents, for example, from 30 to 60 weight percent, which are then added to formulating water to provide the desired solids content in the coating composition. It is sometimes advantageous that the particles constituting the acrylic latex solids should have a glass transition temperature less than 50° C., preferably in the range of 10 to 35° C., most preferably about 20° C. Copolymers having glass transition temperatures appreciably below 10° C. may not present optimal stain resistance. Preferably, the surfactant content of the latex is as low as possible to provide for good water repellency and water resistance.

The antimicrobial agent is present in the primary treatment composition of the first embodiment in an antimicrobially-effective amount, and comprises preferably about 0.25% to about 4% by weight of the primary treatment composition, more preferably 0.40 to about 2 weight percent, and most preferably 0.40 to 1 weight percent. By "antimicrobial agent" is meant any substance or combination of substances that kills or prevents the growth of a microorganism, and includes antibiotics, antifungal, antiviral and antialgal agents. The preferred antimicrobial agents are ULTRA FRESH™ DM-25, ULTRAFRESH™ DM-50 and ULTRAFRESH™ UF-40 available from Thomas Research, and INTERSEPT™, available from Interface Research Corporation. Another preferred antimicrobial agent is AMICAL FLOWABLE™, available from Angus Chemical Company of Northbrook, Ill. Other antimicrobials, particularly fungicides, may be used. Examples are various tin compounds, particularly trialkyltin compounds such as tributyl tin oxide and tributyl tin acetate, copper compounds such as copper 8-quinolinolate, metal complexes of dehydroabietyl amine and 8-hydroxyquinolinium 2-ethylhexoate, copper naphthenate, copper oleate, and organosilicon quarternary ammonium compounds.

The fluorochemical textile treating agent comprises a substantial part of the primary treatment composition, for example, higher than 50 weight percent based on solids. The fluorochemicals provide water repellency and stain resistance and may comprise unbranded generic fluoropolymers. Suitable fluorochemical textile treating agents include, but are not limited to, commercially available fluorochemical compositions. Commercially available fluorochemical compositions such as Zonyl® 8412 and Zonyl® RN available from Ciba-Geigy, SCOTCHGUARD™ FC 255, SCOTCHGUARD™ FC 214-230, available from 3M, and TEFLON® RN, TEFLON® 8070, and TEFLON™ 8787, available from Dupont, are preferred. TEFLON™ 8070 and Zonyl® 8412 are the most preferred fluorochemicals. It is noteworthy that the amount of fluorochemical textile treating agent used is considerably higher than amounts traditionally used for treating upholstery fabric to render it stain resistant, or to provide a minimal amount of hydrophobicity.

Preferred crosslinking resins are the various melamine/formaldehyde and phenol/formaldehyde resins and their variants, particularly CYREZ® 933, a product of the American Cyanamid Company and the self-crosslinking agent WT-50™, a product of the B.F. Goodrich Company comprising about 80 weight percent solids and 20 weight percent water. Other phenol, melamine, urea, and dicyandiamide based formaldehyde resins are available commercially, for example, from the Borden Chemical Company. Preferably, melamine/formaldehyde resin in the amount of 0.1 to about 5.0 weight percent, preferably about 0.25 to 1 weight percent based on the weight of the primary treatment composition is used. Other crosslinkable resins such as oligomeric unsaturated polyesters, mixtures of polyacrylic acid and polyols, e.g. polyvinylalcohol, and epoxy resins may also be used, together with any necessary catalysts to ensure crosslinking during the oven drying cycle.

The liquid repellant, stain resistant, antimicrobial, fabric of the present invention retains its natural "hand" or texture and is therefore aesthetically attractive. The fabric of the present invention is also durable, easy to handle and economical to produce. Of special note is the ability to treat long runs of fabric which is undyed or dyed to a uniform background color, which may be later transfer printed with a suitable design or logo after coating. Transfer printing is uniquely adapted to short runs. The combination of these benefits allows stain resistant, water resistant fabrics of varied patterns to be commercially viable, even in short runs. When fabrics are printed prior to coating, most mills require minimal runs of 2000 yds (1900 m) or more, rendering small runs of printed, then coated fabric, commercially unfeasible.

It would not depart from the spirit of the invention to add additional flame retardants and/or smoke suppressants. Suitable flame retardants are known to those skilled in the art of fabric finishing, and include, for example, cyclic phosphonate esters such as Antiblaze 19T available from Mobil Chemical Co, zinc borate, and other known flame retardants.

The secondary treatment composition also comprises a polyurethane latex, an acrylic latex, one or more antimicrobial agents, and a fluorochemical textile treatment agent. However, in contrast to the primary treatment bath, the weight percent of latex solids is considerably higher, and the amount of fluorochemical correspondingly lower. The secondary treatment composition should contain from 30 to 60 weight percent solids, preferably 40 to 50 weight percent, and most preferably about 45 to 52 weight percent.

Thickeners may be necessary to adjust the rheological properties of the secondary treatment composition. Such thickeners are well known, and include, but are not limited to, water soluble, generally high molecular weight natural and synthetic materials, particularly the latter. Examples of natural thickeners include, but are not limited to, the various water soluble gums such as gum acacia, gum tragacanth guar gum, and the like. More preferred are the chemically modified celluloses and starches, such as methylcellulose, hydroxymethylcellulose, propylcellulose, and the like. Most preferred are high molecular weight synthetic polymers such as polyacrylic acid; copolymers of acrylic acid with minor amounts of copolymerizable monomers such as methyl acrylate, methacrylic acid, acrylonitrile, vinylacetate, and the like, as well as the salts of these compounds with alkali metal ions or ammonium ions; polyvinylalcohol and partially hydrolyzed polyvinylacetate; polyacrylamide; polyoxyethylene glycol; and the so-called associative thickeners such as the long chain alkylene oxide capped polyoxyethylene glycols and polyols or their copolymer polyoxyethylene/polyoxypropylene analogues. The length of the carbon chain of the long chain alkylene oxide in associative thickeners has a great effect on the thickening efficiency, with alkylene residues of 8–30 carbon atoms, preferably 14–24 carbon atoms having great thickening efficiency. The thickeners are preferably used in amounts up to 4 weight percent, and more preferably up to about 2 weight percent or less. In contrast to the urethane and acrylic lattices, in which the solids are dispersed, the thickener solids are water soluble in the amounts used.

The remaining ingredients are similar to those of the primary treatment composition. The preferred compositions further contain zinc ammonium carbonate; calcium stearate dispersion; zinc borate; melamine/formaldehyde resin, preferably CYREZ 933; and sodium polyacrylate thickener solids, supplied as a 14 to 20 weight percent solids solution.

Fire retardants which are dispersible may be added to the secondary treatment composition. An example is Caliban P-44, containing decabromodiphenyloxide and antimony oxide available from White Chemical Company. A suitable smoke suppressant is zinc borate, which may advantageously be used in the preferred amount of 2 weight percent based on solids.

The resulting secondary treatment composition is considerably more viscous than the primary treatment composition, and has a consistency similar to that of PVA wood glue or wallpaper paste. Unlike the primary treatment composition, which is applied to both sides of the fabric by virtue of immersion in a bath, the second and subsequent treatments are applied to one side of the fabric only, the side opposite to that to be exposed to view.

The amount of the secondary treatment composition applied may vary. Preferably, a doctor blade or knife edge is adjusted to touch or nearly touch the fabric surface as the fabric, coated with the composition, passes by. Although the coating may preferably be as much as about 1 mm thick above the fabric, it is more preferred that the wet surface of the coating be at substantially the height of the uppermost yarns of the fabric. When subsequently dried, the thickness of the coating will, of course, be considerably reduced.

It is of great importance that the primary treatment precede the secondary or subsequent treatment(s). The primary treatment interferes with the penetration of the secondary treatment into the fabric, and thus limits the amount of secondary treatment composition which the fabric can obtain with a given knife blade setting. The inability of the secondary treatment composition to substantially penetrate into the fabric assists in maintaining the hand and feel of the fabric, which otherwise could be stiff and boardy.

Following the secondary treatment, the fabric again is preferably oven dried, at temperatures from 250° F. to 350° F. (121° C. to 177° C.), preferably 300 to 350° F. (149° C. to 177° C.). As a result of the primary, secondary, and any subsequent treatments, the weight of the finished fabric will have increased by preferably from 5% to 200%, more preferably from 10% to about 90%, and most preferably from 8% to 20%.

It is believed that both primary and secondary treatment compositions form an interpenetrating polymer network during the heating steps. Fabrics treated with both primary and secondary treatment compositions exhibit excellent water repellency, oil and stain resistance, antifungal and mechanical properties. The ratios of anionic urethane dispersions/acrylic lattices by weight can be from 95/5 to 5/95. The ratios of anionic urethane dispersions and acrylic lattices to organic fluorine lattices can be from 1/99 to 45/55. The ratios of anionic urethane dispersions, acrylic and fluorine lattices to melamine resins can be 99/1 to 80/20. The pigment concentration in the secondary treatment coating can be from 5% to 30% and the antifungus agents can have a concentration range from 0.5% to 5% in both the primary and secondary treatment compositions. The concentration of UV stabilizer in the secondary treatment composition can be from 0.2% to 5%. The amount of flame retardant in the secondary treatment composition can be from 0.5% to 10%.

The primary treatment composition thus contains preferably from about 5 weight percent to about 40 weight percent solids, more preferably from 5 to about 25 weight percent solids, and most preferably from about 10 to about 20 weight percent solids, and is preferably of a viscosity such that relatively thorough penetration of the textile fabric occurs, this penetration optionally being facilitated by passage of treated fabric through pressure rollers, nip rollers, or equivalent devices during or after passage through the primary treatment composition.

Preferably, the primary treatment composition contains from 40–90%, more preferably 70–85% based on solids, of fluorochemical; from about 2% to about 20%, more preferably 4% to about 10%, and most preferably from about 4% to 8% of each of an acrylic latex and a polyurethane latex. Most preferably, the primary treatment composition also contains an effective amount of an antimicrobial agent, such as a mildewcide, fungicide, or other biocidal agent, i.e. about 1 weight percent, and optionally fire retardants and other ingredients. Ammonia may be added for purposes of neutralization and/or increasing viscosity. Non-limiting examples of preferred and most preferred primary treatment compositions are given below in Table 1.

TABLE 1

| Ingredient | Preferred % Range[1] | Most Preferred % |
|---|---|---|
| Zonyl ® 8412 | 70–90 | 83 |
| Hycar ® 1402 | 2–8 | 6.9 |
| PUR 962 | 2–8 | 6.7 |
| Zinplex | 0–2% | 0.7 |
| DM-50 | 0.01–5 | 0.8 |
| $NH_4OH$[2] | 0–5 | 1.5 |

[1]Based on solids
[2]As $NH_4OH$

The secondary treatment composition is preferably generally of higher solids content and contains relatively less fluorochemical than the primary treatment composition. Two or more coats of the primary treatment composition may be made in succession to increase water repellency, with or without addition of a coating of the secondary treatment composition. However, use of a back coat of the secondary treatment composition is preferred when optimal water repellency and stain resistance is desired. The secondary treatment composition also preferably contains a crosslinker, preferably a melamine/formaldehyde resin product or other resinous product containing active methylol groups. Preferred and most preferred secondary treatment compositions are given below in Table 2. Solids content generally lies between 30 and 60 weight percent, preferably between 40 and 50 weight percent, but may be adjusted within wide ranges to achieve the desired fabric pick up weight. When the solids content is lowered, the viscosity generally decreases. In order to raise the viscosity, an increase in the amount of thickener may be desired.

TABLE 2

| Ingredient | Preferred % Range[3] | Most Preferred % |
|---|---|---|
| Zonyl ® 8412 | 2–12 | 5.8 |
| Hycar ® 1402 | 20–80 | 49.6 |
| PUR 962 | 8–40 | 12.8 |
| Zinplex | 0–5 | 0.6 |
| DM-50 | 0–5 | 0.5 |
| $NH_4OH$ | 0–5 | 0.7 |
| Kronos ® 1050 | 0–15 | 6.2 |
| Calsan ® 50 | 0–20 | 14.1 |
| Firebrake ZB | 0–10 | 6.5 |
| Cyrez ® 933 | 0–5 | 0.5 |
| DEEFO ® 215 | 0–5 | 1.1 |
| Acrylsol TT-935 | 0–5 | 1.6 |

[3]Based on solids.

The treated fabric of the first embodiment of the subject invention has a number of advantageous and unique characteristics. It is highly water repellant, as well as stain resistant and sufficiently non-flammable to meet various flammability requirements. While highly water repellant, the fabric allows ready passage of water vapor, and is thus eminently suited for items such as boat covers, traditionally made of vinyl-coated fabrics. The prior art vinyl-coated fabrics are substantially water vapor impermeable, and contribute to mildew formulation in boats using such covers, while prior art latex-coated fabrics do not possess the requisite weather resistance, particularly with regard to photodegradation. The treated fabric has substantially the same hand, feel, texture, and drape of uncoated fabric, and thus can be manipulated by traditional manufacturing techniques as well as being aesthetically pleasing. The fabric is also considerably more resistant to tear and opening at needle holes, as well as having higher tensile strength. Also, the treated fabric may be transfer printed.

Second Embodiment

The treating process of the second embodiment of the subject invention involves solution coating the fabric with a primary treatment composition which, in its most basic nature, comprises a low solids latex containing a copolymer having a glass transition temperature ($T_g$) of from 10° C. to 35° C., a fluorochemical treating agent, and one or more antimicrobial agents. The nature of the primary treatment composition is such that the fabric is thoroughly treated, the primary treatment composition preferably covering equally well both sides of the fabric as well as the interstitial spaces within the fabric. Preferably, the fabric is then oven dried at elevated temperatures, for example, from 250° F. to 350° F. (121° C. to 177° C.). The fabric thusly treated is mildew resistant and water repellant. In addition, its tensile and tear strengths are markedly improved. Yet, the fabric is very difficult to distinguish from untreated fabric by hand, feel, texture, or ease of handling.

Although the process described above creates a unique new textile material, the material may not be completely water repellant. Inspection of the fabric against a light may reveal multitudinous "pinholes" which may ultimately allow water to pass through the fabric. To render the fabric water repellant, one or more additional coating steps may be necessary, depending on the degree of water repellency desired. Both these additional steps are the same, and involve the application of a secondary treatment composition comprising a high solids polymeric latex, containing a dispersed polymer with $T_g$ of between −40° C. and −10° C., to one side of the fabric. The latex, with the consistency of wallpaper paste or high solids wood glue, is rolled, sprayed, or otherwise applied to the fabric which then passes under a knife blade, doctor blade, or roller which essentially contacts the textile surface, leaving a thin coating, preferably, of approximately 1.5 oz/yd$^2$ (50 g/m$^2$) of material. The coated fabric is then preferably oven dried at 250° F. to 350° F. (121° C. to 277° C.).

The primary treatment composition of the second embodiment is an aqueous bath preferably containing from 3 weight percent to about 25 weight percent solids, more preferably from 4 weight percent to 20 weight percent solids, of which approximately 20 weight percent to 50 weight percent represent latex copolymer solids. The primary treatment composition preferably contains minimally the following components: a copolymer latex; an antimicrobial agent; and a fluorochemical textile treating agent. The primary treatment composition may further include water, a cross linking agent, a fire retardant and/or smoke suppressant, and other additives and auxiliaries such as dispersants, thickeners, dyes, pigments, ultraviolet light stabilizers, and the like.

The copolymer latex is present in an amount sufficient to supply preferably 3 to about 12 weight percent solids to the primary treatment composition, more preferably 3 to about 10 weight percent, and even more preferably 4 to about 7 weight percent. The copolymer particles constituting the latex solids should have a glass transition temperature less than 50° C., preferably in the range of 10 to 35° C., most preferably about 20° C. Copolymers having glass transition temperatures appreciably below 10° to 35° C., most preferably about 20° C. Copolymers having glass transition temperatures appreciably below 10° C. may not present optimal stain resistance. Preferably, the surfactant content of the latex is as low as possible to provide for good water repellency and water resistance.

The nature of the monomers from which the polymer particles of the copolymer latex may be formed may be adjusted by one skilled in the art to provide the properties desired of the coated fabric. Preferably, the latex particles are acrylate copolymers, i.e. copolymers formed from lower alkyl acrylates such as methylacrylate, ethylacrylate, butylacrylate, methylmethacrylate, and the like, as well as additional copolymerizable monomers such as vinyl acetate, acrylonitrile, styrene, acrylic acid, acrylamide, N-methylacrylamide, and urethane acrylates. The presence of crosslinkable groups such as acrylamide and N-methylacrylamide along the polymer backbone is preferred. Terpolymers of styrene, methylacrylate, and ethylacrylate are very suitable. Most preferred is WRL1084, a styrene, methylacrylate, ethylacrylate copolymer containing N-methylacrylamide in the polymer backbone available from B.F. Goodrich, which is preferably present in the primary treatment composition in an amount of about 5 weight percent, based on the weight of the primary treatment composition. The copolymer lattices are available in varying solids contents, for example, from 30 to 60 weight percent, which are then added to formulating water to provide the desired solids content in the first coating composition.

The antimicrobial agent preferably comprises about 0.25% to about 4% by weight of the primary treatment composition, more preferably 0.40 to about 2 weight percent, and most preferably 0.40 to 1 weight percent. Antimicrobial agents suitable for use with the primary treatment composition of the second embodiment include, but are not limited to, the antimicrobial agents suitable for use with the compositions of the first embodiment. The most preferred antimicrobial agent for use with the primary treatment composition of the second embodiment is ULTRAFRESH DM-25, which is preferably present in the primary treatment composition in an amount of about 0.5 weight percent, based on the weight of the primary treatment composition.

The fluorochemical textile treating agent preferably comprises about 6% to about 12% by weight of the primary treatment composition, and more preferably 10% by weight. It is noteworthy that the amount of fluorochemical treating agent used in the primary treatment composition is considerably higher than amounts traditionally used for treating upholstery fabric to render it stain resistant. The fluorochemical textile treating agents suitable for use with the primary treatment composition of the second embodiment include, but are not limited to, the fluorochemical textile treating agents suitable for use with the first embodiment. The most preferred fluorochemical textile treating agent for use in the primary treatment composition is Zonyl® 8070, which is preferably present in the primary treatment composition in an amount of about 10 weight percent, based on the weight of the primary treatment composition.

Crosslinking agents suitable for use in the present invention include, but are not limited to, both chemical agents which promote crosslinking of crosslinkable groups along the latex copolymer chains as well as crosslinkable resins which may crosslink with the copolymer or which are themselves crosslinkable. A preferred crosslinking agent which facilitates copolymer crosslinking is zinc ammonium carbonate. Preferred self-crosslinking resins are the various melamine/formaldehyde and phenol/formaldehyde resins and their variants, particularly CYREZ® 933, a product of the American Cyanamid Company and B.F. Goodrich. Other phenol, melamine, urea, and dicyandiamide based formaldehyde resins are available commercially, for example, from the Borden Chemical Company. Preferably, melamine/formaldehyde resin in the amount of 0.1 to about 1.0 weight percent, more preferably about 0.25 weight percent based on the weight of the aqueous treating composition is used. The most preferred crosslinking agent for use with the primary treating composition is WT-50 from B.F. Goodrich, which is preferably present in the primary treatment composition in an amount of about 0.25 weight present, based on the weight of the primary treatment composition. Other crosslinkable resins such as oligomeric unsaturated polyesters, mixtures of polyacrylic acid and polyols, e.g. polyvinylalcohol, and epoxy resins may also be used, together with any necessary catalysts to ensure crosslinking during the oven drying cycle.

As with the primary treatment composition of the first embodiment, it would not depart from the spirit of the invention to add additional flame retardants and/or smoke suppressants. Suitable flame retardants are known to those skilled in the art of fabric finishing, and include, for example, cyclic phosphorate esters such as Antiblaze 19T available from Mobil Chemical Co.

The order of mixing the ingredients of the primary treatment composition is not very critical. In general, the copolymer latex is first mixed with make-up water and stirred at ambient temperature until uniformly dispersed, following which the antimicrobial agent and fluorochemical treating agent and other ingredients are added. The mixture is stirred until a uniform dispersion is obtained. Water most preferably is present in the primary treatment composition in an amount of about 84 weight percent, based on the weight of the primary treatment composition.

The treating process of the second embodiment of the subject invention is advantageously applied to flame barrier fabrics prepared from corespun yarns, preferably with a fiberglass core, as disclosed in U.S. Pat. Nos. 4,921,756, 4,996,099, and 5,091,243. The yarns used in these fabrics comprise an interior core of fiberglass or other non-flammable fiber covered by a shell of polymeric synthetic fibers. Preferably, the synthetic fibers are staple fibers, and are overwrapped in a spiral fashion by continuous fibers to maintain yarn integrity other flame barrier fabrics may be utilized as well.

The polymeric synthetic fiber which surrounds the non-flammable core of the corespun yarn may be one of a number of synthetic polymer fibers, including, but not limited to, acrylic, modacrylic, polyester, nylon, and the like. For treated fabrics which are to be subsequently transfer printed, the synthetic polymer fibers should be able to withstand the heat of the transfer printing process.

The secondary treatment composition of the second embodiment preferably minimally comprises a copolymer latex, one or more antimicrobial agents and a fluorochemical textile treating agent. However, in contrast to the primary treatment composition, the copolymer of the copolymer latex of the secondary treatment composition has a glass transition temperature of 0° C. or lower, preferably −10° C. or lower, and preferably within the range of −40° C. to −10° C., and is preferably a styrene/acrylate copolymer. The amount of copolymer latex solids is also considerably higher, for example, 90–95% of a 50% solids latex. The secondary treatment composition preferably should contain from 30 to 60 weight percent copolymer solids, more preferably 35 to 55 weight percent, and most preferably about 45 to 52 weight percent. Thickeners are generally necessary to adjust the rheological properties of the secondary treatment composition. Suitable thickeners which are useable with the secondary treatment composition include, but are not limited to, the thickeners which are useable with the first embodiment. The thickeners may preferably be used in amounts up to 4 weight percent, and more preferably about 2 weight percent or less.

The remaining ingredients are similar to those of the primary treatment composition, and may preferably include, based on 200 lbs (91 Kg) of 50% solids treatment composition, from 2 to 12 lbs (0.91 to 5.4 Kg) fluorochemical textile treating agent, preferably 4 to 10 lbs (1.8 to 4.5 Kg), and even more preferably, about 10 lbs (2.7 to 3.6 Kg); 0.25 to 3 lb (0.11 to 1.4 Kg) of one or more microbicides, preferably 0.5 to 2 lbs (0.23 to 0.91 Kg), and more preferably about 0.5 lb (0.23 Kg) each of ULTRAFRESH™ DM-50 and ULTRAFRESH™ UF-40 biocides available from Thompson Research Corporation. A preferred composition, on the same basis, further contains 2 weight percent zinc ammonium carbonate; 20 lbs (9.1 Kg) of an aqueous 50% solids calcium stearate dispersion; 2 lbs (0.91 Kg) zinc borate; 0 to 3 lbs (0 to 1.4 Kg) melamine/formaldehyde resin, preferably CYREZ 933; and 2 weight percent of sodium polyacrylate thickener solids, supplied as a 14 to 20 weight percent solids solution.

A most preferred composition of the secondary treatment composition is

| Material | % solids | wt. lbs. |
|---|---|---|
| Polymer Latex | 50 | 200[1] |
| Fluorochemical | 20 | 10[2] |
| Crosslinker | 80 | 3.84[3] |
| Ammonium Hydroxide | — | 6.0 |
| UF-40 Biocides | 25 | 0.64 |
| Calcium Carbonate Dispension | 50 | 20 |
| Acrysol TT-615[4] | 35 | 2.86 |
| ASE 95 | 18 | 25 |
| ALCO 1370 | 14 | 10.71 |
| Zirconium Acetate Catalyst[5] | 20 | 2.5 |
| Polydimethyl-siloxane | — | 12.5 |

[1]Hycar 0202/WRL 0202/Hycar 1022 (Styrene acrylic latex)
[2]Zonyl ® RN
[3]Melamine/formaldehyde resin
[4]Acrylic Thickener
[5]Bacote 20

Fire retardants which are dispersible may be added to the secondary treatment composition in the place of or in addition to those previously described. An example is Caliban P-44, containing decabromodiphenyloxide and antimony oxide available from White Chemical Company. A suitable smoke suppressant is zinc borate, which may be used in the amount of 2 weight percent based on solids.

The resulting secondary treatment composition is preferably considerably more viscous than the primary treatment composition, and preferably has a consistency similar to that of PVA wood glue or wallpaper paste. If the fabric is to be subsequently transfer printed, the composition may further contain 3 to 7 weight percent polydimethylsiloxane silicone fluid. This fluid counteracts the tackiness which may develop in the coating during the elevated temperatures associated with transfer printing which might otherwise result in the coating sticking to the print blanket which surrounds the heated transfer printing roll.

Unlike the primary treatment composition, which is applied to both sides of the fabric by virtue of immersion in a bath, the second and subsequent treatments are applied to one side of the fabric only, the side to be exposed to view.

The amount of the secondary treatment composition applied may vary. Preferably, a doctor blade or knife edge is adjusted to touch or nearly touch the fabric surface as the fabric, coated with the composition, passes by. Although the coating may preferably be as much as 1 mm thick above the fabric, it is more preferred that the wet surface of the coating be at substantially the height of the uppermost yarns of the fabric. When subsequently dried, the thickness of the coating will, of course, be considerably reduced.

It is of great importance that the primary treatment precede the secondary or subsequent treatment(s). The primary treatment interferes with the penetration of the secondary treatment into the fabric, and thus limits the amount of secondary treatment composition which the fabric can obtain with a given knife blade setting. The inability of the secondary treatment composition to substantially penetrate into the fabric assists in maintaining the hand and feel of the fabric, which otherwise would be stiff and boardy.

Following the secondary treatment, the fabric again is preferably oven dried, at temperatures from 250° F. to 350° F. (121° C. to 277° C.), preferably 300 to 350° F. (149° C. to 277° C.). As a result of the primary, secondary, and any subsequent treatments, the weight of the finished fabric will preferably have increased by from 70% to 200%, more preferably from 80% to about 150%, and most preferably from 90% to 120%.

As mentioned above, the fabric of the present invention is durable, easy to handle and economical to produce. Because the fabric retains its "hand" or texture, the fabric is easy to sew and seams are less noticeable, and more durable. For example, when vinyl is sewed, the needle holes tend to open when the vinyl is stretched. With the fabric of the present invention, needle holes do not tend to open and thus the seams are stronger and less noticeable. The fabric of the present invention also has flame retardant characteristics, as described in greater detail below. Moreover, while the fabric provides a moisture barrier, it is believed that vapors are allowed to pass through the fabric. Human skin which may come in contact with the fabric, for example in upholstery applications, is therefore less likely to perspire.

The following Specific Examples further describes the second embodiment of the present invention and are not intended to be limiting unless otherwise specified.

EXAMPLE 1

A heat set and scoured polyester fabric of 40 picks/inch (15.7-picks/cm), previously dyed an emerald green color, was immersed into a primary, aqueous treatment bath containing 5 weight percent latex solids, WRL 1084 (B.F. Goodrich), 10 weight percent TEFLON® 8070 fluorochemical, 0.25 weight percent CYREZ 933 melamine/formaldehyde resin, and 0.5 weight percent of ULTRAFRESH® DM25 biocide, balance water. The treated fabric was passed through nip rolls whose pressure was adjusted to provide for 100% primary treatment composition pickup. The fabric was then dried for approximately 2 minutes by passage through a drying oven maintained at 325° F. (163° C.). The primarily treated fabric exhibited a c.a. 9% weight gain after drying. The resulting primarily treated fabric displayed virtually no change in color, was able to support a considerable column of water, indicating good water repellency, and was stain resistant. The fabric was water vapor permeable, and had excellent hand, feel, and texture. The tear strength and tensile strength was considerably improved relative to the untreated fabric. Examination of the fabric against a strong light showed the presence of numerous pinholes. Nevertheless, the water repellency was such as to make the fabric eminently well suited for boat covers and other outdoor applications, particularly those where water vapor transmission is desirable.

EXAMPLE 2

An undyed polyester fabric similar to that used in Example 1 was subjected to the primary treatment of Example 1. The fabric, when viewed against a strong light, exhibited numerous pinholes, but was water repellant. The primarily treated fabric was then coated with a secondary treatment composition containing 200 lbs (91 Kg) of a 50 weight percent solids latex identified as WRL 1402 available from B.F. Goodrich; 2 lbs (0.91 Kg) CYREZ® 933 melamine/formaldehyde resin; 2 lbs (0.91 Kg) zinc borate; 7 lbs (3.2 Kg) Zonyle RN fluorochemical, available from DuPont 20 lbs (9.1 Kg) of a 50 weight percent calcium stearate dispersion; 2 lbs (0.91 Kg) of zinc ammonium carbonate; 1.0 lb (0.45 Kg) each of ULTRAFRESH® DM 50 and UF40 biocides; and 7 lb (3.2 Kg) polydimethylsiloxane available from the DOW Chemical Company. The secondary coating composition has the consistency of wallpaper paste, after thickening with 2 lbs. (0.91 Kg) of polyacrylate thickener.

The fabric, coated with excess secondary treatment composition on the uppermost side only, was passed below a knife blade adjusted to contact the topmost yarn surfaces of the fabric, removing excess secondary treatment solution. The fabric was then dried in a drying oven maintained at 325° F. (163° C.) For a period of 2 minutes.

The fabric obtained after the secondary treatment showed an increase in weight of about 70% based on the virgin fabric. The fabric was virtually totally water repellant, supporting a higher column of water than the same fabric after treatment with the primary treatment bath only. However, examination under a strong light showed evidence of occasional pinholes. The fabric had excellent hand and feel, although somewhat stiffer than the virgin fabric.

The same fabric was subjected to a subsequent treatment identical to the previous secondary treatment. Total weight gain after drying, relative to the virgin fabric, was 100%. Examination against a strong light showed no observable pinholes.

After the fabric has been suitably coated, the fabric is caused to be printed by transfer printing. Transfer printing is generally known in the art. In transfer printing, color designs mounted on paper carriers are transferred to the coated fabric. The color designs may be transferred from the paper carriers to the coated fabric by pressure-heat contact methods or by heat-vaporization (sublimation) methods. For example, color-prints on a paper carrier are made to come in continuous contact with the treated fabric, and while in contact, pressure is applied between a blanket and a roller. The pressure is about 50 lbs/in$^2$ (34 N/cm$^2$) to about 60 lbs/in$^2$ (41 N/cm$^2$), with 60 lbs/in$^2$ (41 N/cm$^2$) preferred. Heat is also applied at about 380° F. to about 430° F. (193° C. to 221° C.), preferably at 420° F. (216° C.) The dwell time, or time where heat and/or pressure are applied, is a time sufficient for the prints to be transferred to the fabric, preferably about 15 sec to about 30 sec. The heat and pressure permit the transfer of the color design from the paper carrier to the fabric. Transfer of the prints from the paper carrier can also be effected by the use of heat-vaporization methods, known to those skilled in the art. It will, of course, be appreciated by those skilled in the art that the coated fabric of the present invention may have color prints printed thereon in any number of ways, and there is no limitation on the number of colors, the variations and graduation of color, and number of different configurations of prints that can be applied. Moreover, there are any number of ways such prints can be transferred to the coated fabrics and the above are merely representative methods.

The treated fabric of Example 2 of the present invention was tested for flammability, resistance to staining, resistance to yarn slippage at seams, tensile strength and tear strength. The following is a summary of the tests and testing results.

Flammability. The treated fabric was tested in accordance with the State of California Home Furnishings Act, Bulletin 117 Section E, (Cal. 117) using apparatus and methods outlined in Title 16 C.F.R. Section 1610 "Standard for the Flammability of Clothing Textiles," herein incorporated by reference. The treated fabric of the present invention met the standards set forth in the State of California Home Furnishings Act, Bulletin 117 Section E. The treated fabric was further rated as a UFAC Class 1 material.

Resistance to Staining. The treated fabric was tested under the BFTB 402 Standard test conditions for resistance to staining. The following rating system was used:

| | |
|---|---|
| Class 4: | Complete removal |
| Class 3: | Good removal, traces of stain removed |
| Class 2: | Fair removal, more than 50% stain removed. |
| Class 1: | Poor removal, less than 50% stain removed |

The following table summarizes the test results:

| | RATING FOR AMOUNT OF REMOVAL | | | |
|---|---|---|---|---|
| | Water Base Removal | | Solvent Base Removal | |
| Type of Stain | After 5 min. Aging | After 5 min. Aging | After 5 min. Aging | After 5 min. Aging |
| Blood | Class 4.0 | Class 4.0 | Class 4.0 | Class 4.0 |
| Urine | Class 4.0 | Class 4.0 | Class 4.0 | Class 4.0 |
| Betadine | Class 4.0 | Class 4.0 | Class 3.0 | Class 2.0 |

Resistance to Yarn Slippage at Seams. The treated fabric was tested under the ASTM D4034 standard test conditions for resistance to yarn slippage at seams. The ASTM D 3597 specification for woven upholstery fabrics (plain, tufted or flocked) requires a 25 lb (111 N) minimum. In the preliminary test, the seam thread break was at 95 lbs (423 N) and the fill seam thread break was at 87 lbs (387 N). In the remaining four samples, the average seam strength, caused by thread break, was 92 lbs (409 N).

Tensile Strength. The treated fabric was tested under the ASTM D 5034 standard test conditions for tensile strength (grab). The ASTM D 3597 specification for woven upholstery fabric requires a 50 lb (222 N) minimum. Five samples were tested and the average tensile warp strength was 284.8 lbs (1.27) KN) and the average tensile fill strength was 196.4 lbs (874 N).

Tear Strength. The treated fabric was tested under the ASTM D 2261 standard test conditions for tear strength (tongue). The ASTM D 3597 specification for woven upholstery fabrics (plain, tufted or flocked) requires a 6 lb (27 N) minimum. Five samples were tested and the average across the wrap was 15.4 lbs (68.5N) and the average across fill was 15.4 lbs (68.5 N).

Third Embodiment

The primary treatment composition of the third embodiment minimally contains a fluorochemical textile treating agent. The primary treatment composition preferably also contains at least one antimicrobial agent and water. The primary treatment composition may also preferably include a crosslinking agent, a fire retardant and/or smoke suppressant, and other additives and auxiliaries such as dispersants, thickeners, dyes, pigments, ultraviolet light stabilizers, and the like. It would not depart from the spirit of the invention to include a minor amount of a dispersible polymer latex. However, the viscosity of the primary treatment should preferably be low enough that thorough penetration of the fabric is obtained.

The fluorochemical textile treating agent preferably comprises from about 5 to about 20 weight percent of the primary treatment composition, based on the weight of the primary treatment composition, more preferably from about 6 to about 12 weight percent, and most preferably about 10 weight percent. Suitable fluorochemical treating agents for use in the primary treatment composition of the third embodiment include, but are not limited to, the fluorochemical compositions suitable for use in the treatment compositions of the first and second embodiments. The most preferred fluorochemical textile treating agent for use with the primary treatment composition of the third embodiment is Zonyl® 8070. The fluorochemical treating agent typically comprises from about 5 to about 25 weight percent solids, based on the weight of the fluorochemical treating agent, and preferably comprises from about 8 to about 18 weight percent solids, and even more preferably comprises about 17 weight percent solids. It is noteworthy that the amount of fluorochemical treating agent used in the primary treatment composition is considerably higher than traditionally used for treating upholstery fabric to render it stain resistant.

The antimicrobial agent preferably comprises from about 0.25 to about 4 weight percent of the primary treatment composition, based on the weight of the primary treatment composition, and more preferably from about 0.40 to about 2 weight percent, and most preferably about 0.60 weight percent. Suitable antimicrobial agents for use in the primary treatment composition of the third embodiment include, but are not limited to, the antimicrobial agents indicated as suitable for use in the compositions of the first and second embodiments. The most preferred antimicrobial agent for use with the primary treatment composition of the third embodiment is ULTRAFRESH™ DM-25.

Crosslinking agents suitable for use in the primary treatment composition of the third embodiment include resins which are themselves crosslinkable. Suitable crosslinking resins include, but are not limited to, the crosslinking resins suitable for use in the composition of first and second embodiments. Preferably the self-crosslinking agent is present in the primary treatment composition in an amount of from about 0.1 to about 3.0 weight percent, based on the weight of the primary treatment composition, and more preferably in an amount of less than about 1.0 weight percent. Most preferably, the self-crosslinking agent is WT-50™ and is present in the primary treatment composition in an amount of about 0.25 weight percent, based on the weight of the primary treatment composition.

The primarily treated fabrics produced by the subject process can have flame retardants and/or smoke suppressants added to them to improve the flame retardency of the fabrics. Suitable flame retardants are known to those skilled in the art of fabric finishing, and include, for example, cyclic phosphorate esters such as Antiblaze™ 19T available from Mobil Chemical Co.

The order of mixing the components of the primary treatment composition is not very critical. In general, the antimicrobial agent, the fluorochemical treating agent, the crosslinking agent and any other ingredients are added to water in any order. The mixture is stirred until a uniform dispersion is obtained. The water is preferably present in the primary treatment composition in an amount of from about 70 to about 95 weight percent, based on the weight of the primary treatment composition, and more preferably from about 85 to about 90 weight percent, and most preferably about 89 weight percent.

The fabric to be primarily treated may be drawn through a bath of the primary treatment composition by any convenient method, or the primary treatment composition may be sprayed or rolled onto the fabric. Preferably, the fabric, previously scoured to remove textile yarn finishes, soaps, etc., is drawn through a bath of the primary treatment composition, as the topical composition of the first treating step should uniformly coat both surfaces of the fabric as well as penetrating the surfaces of the fabric to cover the interstitial spaces within the fabric. The fabric, after being drawn through a bath of the primary treatment composition, may be passed through nips or nip rollers to facilitate more thorough penetration of the primary treatment composition into the fabric and/or to adjust the amount of the primary treatment composition relative to the fabric. By such or other equivalent means, the pickup is adjusted to provide from about 30 to about 200 weight percent pickup relative to the weight of the untreated fabric, more preferably from about 60 to about 150 weight percent, and most preferably from about 80 to about 120 weight percent. About a 100 weight percent addition of primary treatment composition relative to the weight of the untreated fabric is considered optimal with normal primary treatment composition solids content.

The coated fabric is then passed through an oven maintained at an elevated temperature, preferably from 250° F. to 350° F. (121° C. to 277° C.) For a period of time sufficient to cure the applied primary treatment composition. By the term "cure", as used in the previous sentence, it is meant to dry the applied primary treatment composition, and, if the first treatment step is not to be followed by additional primary treatments, to perform any necessary crosslinking of the components of the primary treatment composition. Generally, a period of from 1 to 8 minutes, preferably about 2 minutes at 325° F. (163° C.) is sufficient.

The secondary treatment composition minimally comprises a fluorochemical textile treatment agent. The secondary treatment composition may also preferably contain a copolymer latex and one or more antimicrobial agents. The secondary treatment composition preferably comprises from about 30 to about 70 weight percent solids, based on the weight of the secondary treatment composition, and preferably from about 40 to about 60 weight percent solids, and most preferably from about 40 to about 50 weight percent solids.

The secondary treatment composition preferably contains from about 4 to about 20 weight percent, of a fluorochemical textile treating agent, based on the weight of the secondary treatment composition, and more preferably about 5 to about 15 weight percent, even more preferably about 6 to about 10 weight percent and most preferably about 6 weight percent. Fluorochemical treatment agents suitable for use with the secondary treatment composition include, but are not limited to, the fluorochemical treatment agents suitable for use with the treatment compositions in the first and second embodiments. TEFLON® RN is the most preferred fluorochemical treating agent for use in the secondary treatment composition of the third embodiment. It is noteworthy that the amount of fluorochemical treating agent used in the secondary treatment composition is considerably higher than amounts traditionally used for treating upholstery fabric to render it stain resistant.

The copolymer of the copolymer latex of the secondary treatment composition, when a copolymer latex is present, preferably has a glass transition temperature of 0° C. or lower, preferably −10° C. or lower, and more preferably within the range of −40° C. to −10° C., and is preferably a styrene/acrylate copolymer. The most preferred copolymer latex is the styrene/acrylate copolymer latex Hycar™ 0202, a copolymer latex comprising about 50 weight percent solids which is available from the B.F. Goodrich Company of Akron, Ohio. The secondary treatment composition preferably contains from about 30 to about 80 weight percent copolymer latex, based on the weight of secondary treatment composition, and more preferably, from about 40 to about 70 weight percent, and even more preferably about 55 to about 62 weight percent, and most preferably about 61 weight percent. The copolymer latex preferably comprises from about 30 to about 70 weight percent solids, based on the weight of the copolymer latex, more preferably from about 40 to about 60 weight percent solids, and most preferably about 50 weight percent solids.

Thickeners are generally necessary to adjust the Theological properties of the secondary treatment composition. Suitable thickeners include, but are not limited to, the thickeners useful with the treatment compositions of the first and second embodiments. Some preferred acrylic thickeners for use with the secondary treatment composition of the third embodiment are JATHIX 175™, which is preferably present in the secondary treatment composition in an amount of about 8 weight percent, based on the weight of the secondary treatment composition, and ACRYLSOL TT615™, which is available from the Rohm and Haas Co., of Philadelphia, Pa. and is preferably present in the secondary treatment composition in an amount of about 1 weight percent, based on the weight of the second treatment composition. The thickener may preferably be used in amounts up to 12 weight percent, based on the weight of the secondary treatment composition, and more preferably from about 6 weight percent to about 10 weight percent, and even more preferably about 10 weight percent or less. In contrast to the copolymer latex, in which the solids are dispersed, the thickener solids are water soluble in the amounts used.

The secondary treatment composition may also include one or more antimicrobial agents in a preferred amount of from about 0.1 to about 2 weight percent, based on the weight of the secondary treatment composition, and more preferably from about 0.2 to about 1 weight percent, and even more preferably about 0.4 weight percent. Antimicrobial agents suitable for use with the secondary treatment composition include, but are not limited to, the antimicrobial agents suitable for use with the treatment compositions of the first and second embodiments. Most preferably the secondary treatment composition contains about 0.2 weight percent, based on the weight of the secondary treatment composition, each of ULTRAFRESH™ DM-25 available from Thompson Research and AMICAL FLOWABLE™ available from Angus Chemical Company.

The secondary treatment composition may also include a pH adjuster. Suitable pH adjusters include, but are not limited to, ammonium compositions such as ammonium hydroxide and zinc ammonium carbonate. When a pH adjuster is used in the secondary treatment composition, it is preferred that it be present in the secondary treatment composition in an amount of no more than about 5 weight percent, based on the weight of the secondary treatment composition. More preferably, the pH adjuster is present in the secondary treatment composition in an amount of less than about 2.5 weight percent, based on the weight of the secondary treatment composition. Most preferably, the pH adjuster is ammonium hydroxide and is present in the secondary treatment composition in an amount of about 1.8 weight percent, based on the weight of the secondary treatment composition. Addition of pH adjusters may augment the thickening ability of polyacrylic acid and similar thickeners.

The secondary treatment composition may also include a crosslinking catalyst. Suitable catalysts include, but are not limited to, zirconium acetate, zinc ammonium carbonate, ammonium chloride, ammonium nitrate and para-toluene sulfonic acid. When a catalyst is used in the secondary treatment composition, it is preferred that it be present in the secondary treatment composition in an amount of no more than about 5 weight percent, based on the weight of the secondary treatment composition. More preferably, the catalyst is present in the secondary treatment composition in an amount of from about 0.5 to about 2 weight percent, based on the weight of the secondary treatment composition. Most preferably, the catalyst is BACOTE 20, a zirconium acetate catalyst, and is present in the secondary treatment composition in an amount of about 0.75 weight percent, based on the weight of the secondary treatment composition.

The secondary treatment composition may also include a self-crosslinking resin. Suitable self-crosslinking resins include, but are not limited to, the self-crosslinking resins useable with the treatment compositions of the first and second embodiments. When a self-crosslinking resin is used in the secondary treatment composition, it is preferred that it be present in the secondary treatment composition in an amount of no more than about 5 weight percent, based on the weight of the secondary treatment composition. More preferably, the self-crosslinking resin is present in the secondary treatment composition in an amount of from about 0.5 to about 2 weight percent, based on the weight of the secondary treatment composition. Most preferably, the self-crosslinking resin in the secondary treatment composition is melamine/formaldehyde resin and is present in the secondary treatment composition in an amount of about 1.1 weight percent, based on the weight of the secondary treatment composition.

The secondary treatment composition may also include any detackifying filler capable of detackify the finish of the secondarily treated fabric. Suitable detackifying fillers include, but are not limited to, felspar slurry, aluminum trihydrate, calcium carbonate, clay and barium sulfate. When a detackifying filler is used in the secondary treatment composition, it is preferred that it be present in the secondary treatment composition in an amount of no more than about 25 weight percent, based on the weight of the secondary treatment composition. More preferably, the detackifying filler is present in the secondary treatment composition in an amount of from about 8 to about 20 weight percent, based on the weight of the secondary treatment composition. Most preferably, the detackifying filler is a 65 weight percent solid aqueous felspar slurry manufactured from E.I. DuPont de Nemours and is present in the secondary treatment composition in an amount of about 16.4 weight percent, based on the weight of the secondary treatment composition.

The secondary treatment composition may also include a detackifying wax to detackify the finish of the secondarily treated fabric. Suitable detackifying waxes include any suitable waxes which are capable of detackifying the finish of the fabric of the present invention, such as paraffin wax, zirconium wax and microcrystalline waxes. Preferably, the detackifying wax is present in the secondary treatment composition in the form of an aqueous wax emulsion containing from about 35 to about 70 weight percent wax, based on the weight of the wax emulsion. When a detackifying wax emulsion is used in the secondary treatment composition, it is preferred that it be present in the secondary treatment composition in an amount of no more than about 15 weight percent, based on the weight of the secondary treatment composition. More preferably, the detackifying wax emulsion is present in the secondary treatment composition in an amount of about 3 to about 8 weight percent, based on the weight of the secondary treatment composition. Most preferably, the detackifying wax emulsion is a paraffin wax emulsion, comprising about 50 weight percent solids, and is available from Cross-link Inc., of Cliffside, N.C., and is present in the secondary treatment composition in an amount of about 4 weight percent, based on the weight of the secondary treatment composition.

Flame retardants which are dispersible may be added to the secondary treatment composition in the place of or in addition to those previously described with respect to the primary treatment composition. An example is Caliban™ P-44, containing decabromodiphenyloxide and antimony oxide available from White Chemical Company. A suitable smoke suppressant is zinc borate, which may be used in the amount of 2 weight percent based on solids.

The order of mixing the components of the secondary treatment composition is not very critical. In general, the components are added to the copolymer latex in any order, with thickeners usually being added last. The mixture is stirred until a uniform composition is obtained. The resulting composition is considerably more viscous than the primary treatment composition, and has a consistency similar to that of PVA wood glue or wallpaper paste. It will be appreciated that the secondary treatment composition could further include other additives and auxiliaries such as dispersants, dyes, pigments, ultraviolet light absorbers, and the like.

The following Specific Examples further describes the third embodiment of the present invention.

EXAMPLE 3

A previously dyed jacquard fabric is immersed into a bath of primary treatment composition containing 10.23 weight percent TEFLON™ 8070 fluorochemical, 0.25 weight percent WT-50™ melamine/formaldehyde resin, and 0.6 weight percent of ULTRAFRESH™ DM-25 biocide, and 88.92 weight percent water. The treated fabric is passed through nip rolls whose pressure is adjusted to provide for 100% primary treatment composition pickup. The fabric is then dried by passage through a drying oven. The resulting treated fabric displays virtually no change in color, is able to support a considerable column of water, indicating good water repellency, and is stain resistant. The resulting fabric is water vapor permeable, and has excellent hand, feel, and texture. The tear strength and tensile strength are considerably improved relative to the untreated fabric. Examination of the treated fabric against a strong light showed the presence of numerous pinholes.

EXAMPLE 4

A jacquard similar to that used in Example 3 is subjected to the primary treatment of Example 3. The primarily treated fabric, when viewed against a strong light, exhibits numerous pinholes, but is substantially water repellant. The primarily treated fabric is then coated with a secondary treatment composition containing 200 lbs of a 50 weight percent solids latex identified as HYCAR™ 0202 available from B.F. Goodrich; 3.75 lbs WT-50™ melamine/formaldehyde resin available from B.F. Goodrich; 2.5 lbs zirconium acetate; 20 lbs Teflon™ RN fluorochemical, available from E.I. DuPont de Nemours; 53.85 lbs of a 65 weight percent solids Felspar slurry; 6 lbs of ammonium hydroxide; 0.64 lb each of ULTRAFRESH™ DM-25 and AMICAL FLOWABLE™ biocides; and 14 lb of a 50 weight percent solid paraffin wax emulsion available from Cross-Link Inc. The secondary treatment composition has the consistency of wallpaper paste, after thickening with 27 lbs. of acrylic thickener.

The fabric, coated with excess secondary treatment composition on the undermost side only, is passed below a knife blade adjusted to contact the undermost surface of the fabric, removing excess secondary treatment composition. The fabric is then dried in a drying oven.

The resulting fabric is virtually totally water repellant, supporting a higher column of water than the same fabric after treatment with the primary treatment composition only. However, examination under a strong light shows evidence of occasional pinholes. The fabric has excellent hand and feel, although it is somewhat stiffer than the virgin fabric. The fabric has the appearance of fabric, not of plastic.

The same fabric is subjected to a subsequent treatment identical to the previous secondary treatment. Examination against a strong light shows no observable pinholes.

It will be appreciated by those skilled in the art that the treatment compositions of the present invention may be varied depending on the desired result of the treating composition. For example, fabrics of tighter weave may require only one or more primary treatments or a primary treatment and one secondary treatment whereas open weave fabrics may require one or more primary treatments and two or more secondary treatments. It will also be appreciated that the combination of the various components of the composition of the present invention may be varied to achieve the desired result. For example, the solids content of the primary treatment composition, secondary composition, or both may be increased to reduce the overall number of treatments required.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the specification and following claims.

What is claimed is:

1. A method of preparing a stain resistant and water repellant textile fabric, said method comprising:

a) treating a textile fabric with an aqueous primary treatment composition, said primary treatment composition comprising about 5 or more weight percent of a fluorochemical textile treating agent, based on the weight of said primary treatment composition;

b) drying the treated fabric to obtain a primarily treated fabric;

c) providing a polymeric film on said primarily treated fabric, said polymeric film comprising an aqueous secondary treatment composition, said secondary treatment composition comprising at least about 4 weight percent of a fluorochemical textile treating agent, based on the weight of said secondary treatment composition; and d) drying the treated fabric with said film to obtain a secondarily treated fabric.

2. The method of claim 1 wherein said primary treatment composition comprises no more than about 20 weight percent of a fluorochemical textile treating agent, based on the weight of said primary treatment composition.

3. The method of claim 2 wherein said secondary treatment composition comprises no more than about 20 weight percent of a fluorochemical textile treating agent, based on the weight of said secondary treatment composition.

4. The method of claim 1 wherein said primary treatment composition further comprises about 0.25 weight percent to about 4 weight percent of an antimicrobial agent, based on the weight of said primary treatment composition.

5. The method of claim 4 wherein said secondary treatment composition further comprises about 0.1 weight percent to about 4 weight percent of an antimicrobial agent, based on the weight of said secondary treatment composition.

6. The method of claim 1 wherein said primary treatment composition further comprises a crosslinkable resin in an amount of from about 0.1 weight percent to about 3 weight percent, based on the weight of said primary treatment composition.

7. The method of claim 6 wherein said crosslinkable resin comprises a melamine/formaldehyde resin.

8. The method of claim 1 wherein said primary treatment composition further comprises at least one polymeric latex.

9. The method of claim 8 wherein said polymeric latex comprises a polyurethane latex.

10. The method of claim 9 wherein said primary treatment composition further comprises an acrylic latex.

11. The method of claim 8 wherein said polymeric latex comprises a copolymer latex.

12. The method of claim 11 wherein said copolymer latex has a glass transition temperature between about 10–50° C.

13. The method of claim 1 wherein said secondary treatment composition further comprise a polymeric latex.

14. The method of claim 13 wherein said polymeric latex comprises a polyurethane latex.

15. The method of claim 14 wherein said secondary treatment composition further comprises an acrylic latex.

16. The method of claim 13 wherein said polymeric latex comprises an copolymer latex.

17. The method of claim 16 wherein said copolymer latex has a glass transition temperature of about 0° C. or less.

18. The method of claim 1 wherein both sides of said textile fabric are treated with said primary treatment composition.

19. The method of claim 18 wherein only one side of said primarily treated fabric is provided with said polymeric film.

20. The method of claim 1 wherein said primary treatment composition has a viscosity of less than about 1,000 cps at room temperature.

21. The method of claim 1 wherein said secondary treatment composition has a viscosity of about 25,000 cps to about 60,000 cps at room temperature.

22. The method of claim 1 wherein said primary treatment composition has a percent solids of about 1% to about 30%.

23. The method of claim 1 wherein said secondary treatment composition has a percent solids of about 30% to about 70%.

24. The method of claim 1 wherein said secondarily treated fabric is liquid water impermeable and water vapor permeable.

25. The method of claim 1 wherein said secondarily treated fabric is transfer printable.

26. The method of claim 8 wherein said secondary treatment composition further comprises a polymeric latex.

27. The method of claim 20 wherein said secondary treatment composition has a viscosity of about 25,000 cps to about 60,000 cps at room temperature.

28. The method of claim 23 wherein said secondarily treated fabric is liquid water impermeable and water vapor permeable.

29. The method of claim 1 wherein in said drying steps of steps (b) and (d), the temperatures are elevated.

* * * * *

UNITED STATES PATENT AND TRADEMARK OFFICE

CERTIFICATE OF CORRECTION

PATENT NO. : 6,251,210 B1
DATED : June 26, 2001
INVENTOR(S) : Craig A. Rubin et al.

It is certified that error appears in the above-identified patent and that said Letters Patent is hereby corrected as shown below:

Column 1,
Lines 1-4, the words
"This application is a continuation-in-part of U.S. patent application Ser. No. 08/687,527, filed Aug. 8, 1996, U.S. Patent No. 6,024,823, entitled "Treated Textile Fabric", and U.S. patent application Ser. No. 09/050,514, filed Mar. 30, 1998, pending, entitled "Treated Textile Fabric", which are hereby incorporated by reference." should be changed to
-- This application is a continuation-in-part of U.S. patent application Ser. No. 08/687,527, which was the national stage of International application NO. PCT/ US95/03566, filed March 21, 1995, entitled "Water-Resistant and Stain-Resistant, Antimicrobial Treated Textile Fabric", now U.S. patent No. 6,024,823, and U.S. patent application Ser. No. 09/050,514, filed Mar. 30, 1998, entitled "Treated Textile Fabric", now U.S. Patent No. 6,207,250, which is a continuation-in-part of U.S. patent application Ser. No. 08/687,527, filed Mar. 21, 1995, which are hereby incorporated by reference. --

Signed and Sealed this

Twenty-ninth Day of January, 2002

*Attest:*

*Attesting Officer*

JAMES E. ROGAN
*Director of the United States Patent and Trademark Office*